United States Patent [19]

Izzi, Sr.

[11] Patent Number: 4,910,811

[45] Date of Patent: Mar. 27, 1990

[54] PLASTIC FLOOR DRAIN

[75] Inventor: Louis B. Izzi, Sr., Shelby, N.C.

[73] Assignee: Plastic Oddities, Inc., Shelby, N.C.

[21] Appl. No.: 111,276

[22] Filed: Oct. 22, 1987

[51] Int. Cl.[4] ..... E03C 1/26; A47K 1/14

[52] U.S. Cl. ..... 4/292; 4/288; 210/163

[58] Field of Search ..... 4/288, 292, 286, 290, 4/291; 210/162–166

[56] References Cited

U.S. PATENT DOCUMENTS

| | | | |
|---|---|---|---|
| 1,375,222 | 4/1921 | Lutz | 210/163 |
| 3,742,525 | 6/1973 | Oropallo | 4/288 |
| 4,146,939 | 4/1979 | Izzi | 4/288 X |
| 4,463,461 | 8/1984 | van den Broeke et al. | 4/290 X |
| 4,593,420 | 6/1986 | Tobias et al. | 4/541 X |

*Primary Examiner*—Stanley N. Gilreath
*Assistant Examiner*—Steven M. duBois
*Attorney, Agent, or Firm*—Laurence R. Brown; Alfred J. Mangels

[57] ABSTRACT

An all plastic floor drain including a rigid plastic connector body and a rigid plastic strainer plate that is received in an annular recess in the connector body. The strainer plate includes a plurality of positioning pins that extend from the lower surface thereof and the annular recess in the connector body includes a corresponding number of positioning apertures to receive the positioning pins. Preferaby, there is free movement between the positioning pins and the positioning apertures when the pins are first inserted in the apertures, but one of the other of the pins or the apertures is tapered so that there is an interference fit as the strainer plate approaches its final position relative to the connector body, to securely connect the strainer plate and the connector body and to provide a substantially flat upper surface level with the surface of the floor. The use of all plastic parts and the absence of metallic connectors avoids corrosion.

14 Claims, 3 Drawing Sheets

PLASTIC FLOOR DRAIN

BACKGROUND OF THE INVENTION

The present invention relates to floor drains in which a bowl-shaped connector is secured to a drain pipe, the bowl having a removable strainer plate that fits on the upper surface of the connector. More particularly, the present invention relates to an all-plastic floor drain assembly in which a plastic strainer plate is removably received and retained in a plastic, bowl-type connector without the use of screws or other metallic connecting means.

DESCRIPTION OF THE RELATED ART

Typically, floor drains include a bowl-shaped connector portion that has an opening adapted to connect the bowl with a drain pipe. An overlying or recessed strainer plate fits over the top of the bowl-portion. The strainer plate includes a plurality of holes that extend through the plate for permitting liquid to flow through the holes and enter the drain, but to prevent large particles of material from entering the drain and thereby possibly clogging it. The floor drains previously known are made of metal, such as brass or cast iron, and they typically have screws, bolts, or other metallic connectors to hold the strainer plate in position on the connector bowl.

With the continued expansion of the use of plastic pipe, it has become desirable to provide a floor drain including a bowl-shaped connector that can be solvent sealed to such a pipe, and that can avoid the corrosion that oftentimes accompanies the use of metallic floor drains, particularly in factories or other areas where strong, corrosive chemicals are likely to flow into the drains. In addition to the likelihood of corrosion of metallic floor drains, the use of screws or bolts can permit the strainer plate to become loose as a result of foot or vehicle traffic over the drain, which could in some instances lead to cocking of the strainer plate relative to the bowl, and thereby present a safety hazard when people walk over the drain.

Accordingly, it is an object of the present invention to provide an all plastic floor drain.

It is another object of the present invention to provide an all plastic floor drain that does not utilize metallic screws or other metallic connection devices.

It is a still further object of the present invention to provide an all plastic floor drain in which the strainer plate can be tightly held in position relative to the bowl without metallic connectors, but yet can be readily separated therefrom for cleanout purposes and easily reinstalled.

SUMMARY OF THE INVENTION

Briefly stated, in accordance with one aspect of the present invention, a plastic floor drain is provided that includes a bowl-shaped connector body and a strainer plate, each of which is molded from a rigid plastic material. The connector body has a longitudinal axis and includes an upper surface having an inlet opening, and a lower surface having an outlet opening. The inlet opening has a larger opening area than that of the outlet opening. The connector body includes an outwardly extending annular flange adjacent the inlet opening to define a recessed annular seat. A plurality of circumferentially spaced positioning apertures are provided in the annular seat, the positioning apertures each having an axis that extends substantially parallel to the longitudinal axis of the connecto body.

The strainer plate has a plurality of drain apertures that extend therethrough, and also has a lower surface that is received on the annular seat in the connector body. A plurality of positioning pins extend from the lower surface of the strainer plate and are received in respective ones of the positioning apertures in the connector body, and in a friction-fit relationship therewith. The strainer plate has an upper surface that is substantially co-planar with the upper surface of the annular flange when the plate is installed in the connector body to thereby provide a smooth continuous upper surface, for the floor drain assembly.

DESCRIPTION OF THE PREFERRED EMBODIMENTS

Figure 1:
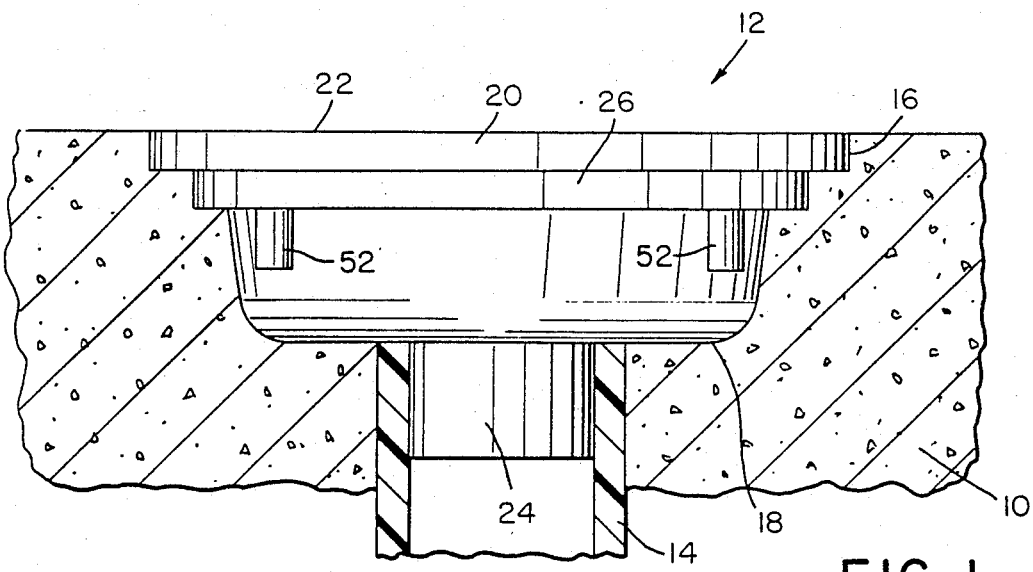
FIG. 1 is a fragmentary view, partially in section, of a floor drain in accordance with the present invention installed in a floor and connected with a drain pipe.

Referring now to the drawings, and particularly to FIG. 1 thereof, there is shown a portion of a floor 10 in which a plastic floor drain 12 in accordance with the present invention is positioned and connected with a drain pipe 14. Floor 10, which can be of concrete or any other flooring material, has a suitable annular recess 16 to receive a bowl-shaped connector body 18 that includes an upper, annular, outwardly extending flange 20 that is received in recess 16, and in such a way that the top surface 22 of the flange is level with the surface of floor 10.

Although referred to as a floor drain, the use of such devices as herein described is not limited to floors, but can also be used in shower stalls, swimming pools, roofs, and the like, wherever a drain is desired that has a top surface flush with the adjacent surface of the surrounding structure.

Bowl-shaped connector body 18 includes a tubular outlet 24 that extends from the bottom of the bowl, and is preferably of such a size as to fit within drain pipe 14. In that regard, floor drain 12 and drain pipe 14 are each made of a plastic material, such as, for example, polyvinyl chloride (PVC) or acrylonitrile butadiene styrene (ABS), each of which has been approved by many regulating authorities for use in drain, waste, and vent applications. As will be apparent to those skilled in the art, the floor drain should be the same material as the drain pipe material, and the outer surface of tubular outlet 24 can be sealingly secured to the inner surface of drain pipe 14 by a suitable plastic solvent, or the like, to provide a strong, leak-proof connection therebetween.

Figure 5:
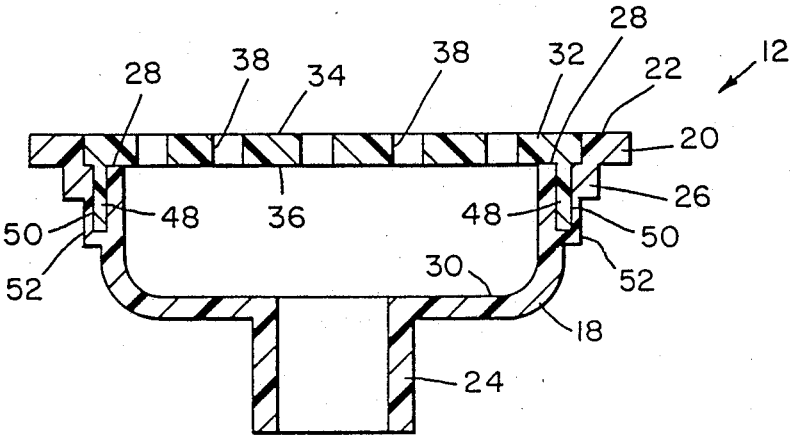
FIG. 5 is a cross-sectional view of the floor drain shown in FIG. 1, and taken diagonally therethrough.

Connector body 18 includes a lower flange 26 immediately below upper flange 20, and which is recessed radially inwardly from the outer edge of upper flange 20 (see FIG. 2). The top surface of lower flange 26 defines an annular seat 28 which is concentric with upper flange 20. As best seen in FIG. 5, the inner wall 30 of bowl 18 curves downwardly and inwardly toward tubular outlet 24.

Figure 3:
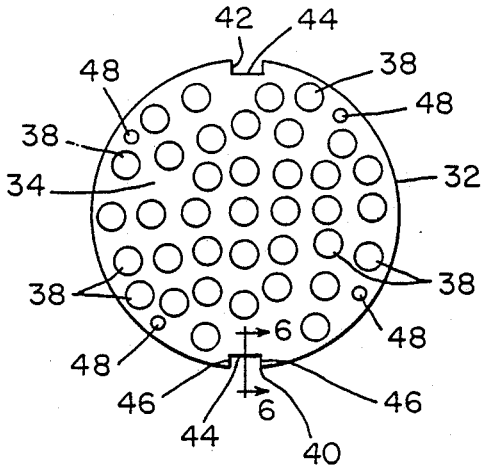
FIG. 3 is a bottom plan view of the strainer plate that forms a part of the floor drain shown in FIG. 1.
Figure 4:
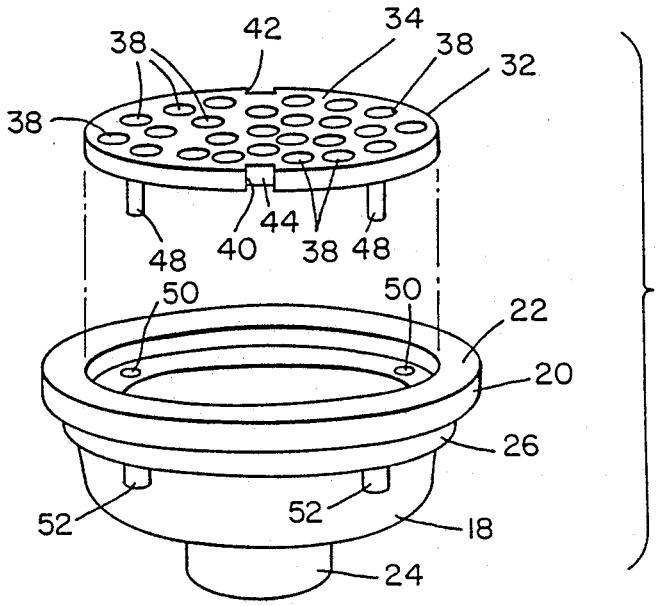
FIG. 4 is an exploded perspective view of the two parts of the drain shown in FIG. 1.

Referring now to FIGS. 3, 4, and 5, the floor drain includes a strainer plate 32 in the form of a circular disc, and has upper surface 34 and lower surface 36 that are substantially parallel to each other. The circular conformation of strainer plate 32 permits it to fit within outer flange 20 and to rest upon annular seat 28. Additionally, the thickness of plate 32 is preferably such that it corresponds with the distance between the top surface 22 of upper flange 20 and annular seat 28, so that upper surface 34 of the strainer plate is substantially co-planar with top surface 22. Strainer plate 32 includes a plurality of through apertures 38 that are distributed over the upper and lower surfaces thereof and extend from upper surface 34 to lower surface 36 to permit passage therethrough of liquids and small particulate materials, but to prevent the passage therethrough of larger particles that could clog the drain pipe.

Figure 6:
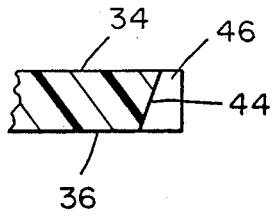
FIG. 6 is an enlarged, fragmentary, cross-sectional view taken along the line 6—6 of FIG. 3.

As best seen in FIGS. 3 and 4, strainer plate 32 includes a pair of diametrically opposed, inwardly extending peripheral notches 40, 42 that are defined by flat, innermost notch walls 44, and a pair of opposed substantially parallel notch walls 46. For reasons that will hereinafter be explained, each of notch walls 44 and 46 slopes inwardly from upper surface 34 to lower surface 36 (see FIG. 6), toward the axis passing perpendicularly through the center of the circle defined by the periphery of plate 32.

A plurality of spaced positioning pins 48 extend in a downward direction from lower surface 36 of strainer plate 32 and have longitudinal axes that extend in a direction parallel to the strainer plate axis. The axes of the positioning pins 48 each lie on a circle of predetermined radius and the pins are adapted to be received in respective ones of corresponding positioning apertures 50 formed in the annular seat 28 in connector body 18, and serve to positively position strainer plate 32 with respect to connector body 18. Preferably, both positioning pins 48 and positioning apertures 50 are of circular cross section, although other cross-sectional shapes, such as square or rectangular, can also be utilized if desired.

Referring once again to FIG. 5, as there shown both positioning pins 48 and positioning apertures 50 are tapered so that they have a larger cross-sectional area adjacent their respective upper ends, as compared with their lower ends. Such an arrangement permits positioning pins 48 to be readily inserted into the positioning apertures 50, and the provision of a slightly smaller taper in the positioning apertures, with a smaller cross-sectional area at the innermost ends thereof, as compared with that at the lowermost ends of the positioning pins, provides an interference fit therebetween, so that when lower surface 36 of strainer plate 32 contacts annular seat 28, there is interference between the positioning pins and the respective positioning apertures which serves to tightly retain strainer plate 32 in position in connector body 18. Such a connection eliminates the need to use metallic screws, bolts, or the like, and thereby avoids the corrosion that can exist when such metallic connectors are used. As seen in FIG. 4, the material surrounding the outermost walls of positioning apertures 50 defines projections 52, that extend radially outwardly from connector body 18 in substantially semi-cylindrical form. Each positioning apertures includes a transversely extending bottom wall that serves to limit downward movement of the positioning pins.

Figure 7:
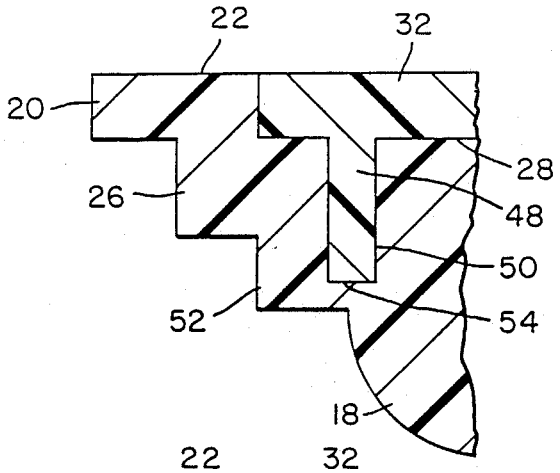
FIG. 7 is an enlarged, fragmentary, cross-sectional view showing one form of connection between the strainer plate and the bowl-shaped connector for removably connecting the strainer plate to the connector body.
Figure 8:
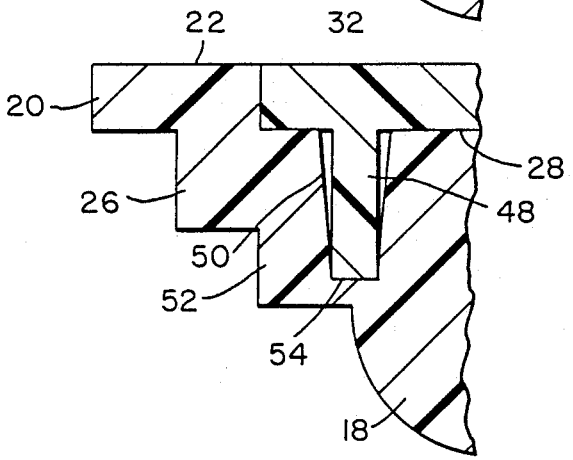
FIG. 8 is an enlarged, fragmentary, cross-sectional view showing another form of connection between the strainer plate and the bowl-shaped connector body.
Figure 9:
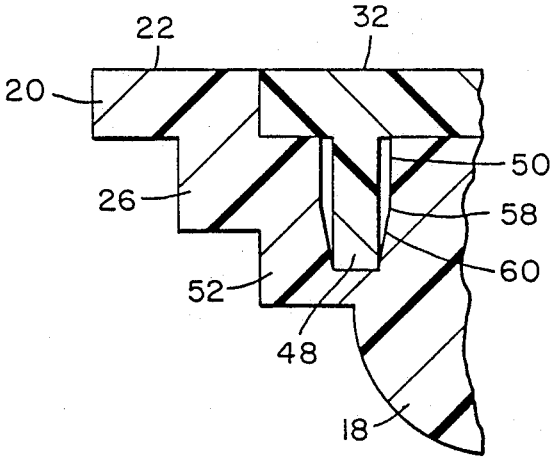
FIG. 9 is an enlarged, fragmentary, cross-sectional view similar to FIGS. 7 and 8, and showing still another form of connection between the strainer plate and the bowl-shaped connector body.

Referring now to FIGS. 7, 8, and 9, there are shown alternative configurations for positioning pins 48 and positioning apertures 50. In the FIG. 7 embodiment, both the positioning pin and the positioning aperture are cylindrical, and the bottom of the positioning pin contacts the transversely extending step in the connector body. Preferably, the diameters of the pins and apertures are such as to provide an intereference fit therebetween.

In the FIG. 8 embodiment positioning pin 48 is cylindrical, and aperture 50 is tapered in such a way that the cross-sectional area of aperture 50 adjacent the bottom wall 54 is smaller than the cross-sectional area at annular seating surface 28, which facilitates the insertion of the positioning pins into the positioning apertures, yet provides sufficient interference therebetween when the strainer plate is in its lowermost positions, relative to the connector body, to provide the desired interference fit for a tight connection therebetween.

In the FIG. 9 embodiment, positioning pin 48 is cylindrical, and positioning aperture 50 is defined by a cylindrical upper portion 56 and a transition point 58 below which the positioning aperture is defined by a tapered portion 60 that tapers downwardly and inwardly, again to provide a smaller cross-sectional area so that there is an interference fit between the positioning pin and the positioning aperture.

After strainer plate 32 is securely connected with connector body 18, if it is desired for some reason to remove the strainer plate, as, for example, to perform a cleanout operation, strainer plate 32 can be removed from the connector body 18 by inserting the blade of a screwdriver, or the like into notches 40 and 42 to pry the plate in an upward direction and overcome the interference fit between the positioning pins and the positioning apertures. Alternatively, removal of plate 32 can be effected by inserting one or more L- or J-shaped rods through the openings in the strainer plate in such a way as to cause the leg of the L or J to contact lower surface 36 of strainer plate 32, and then pulling upwardly on one or more of such rods. Such a removal rod arrangement can be utilized with a single rod passing through the center drain hole of the strainer plate, or, if two such removal rods are to be utilized they should be positioned in diametrically opposed drain holes spaced equally from the center of the strainer plate so that the strainer plate is lifted upwardly without cocking. Reapplication of the strainer plate is effected by merely aligning the positioning pins with the positioning holes and firmly pressing the strainer plate in a downward direction against the connector body.

Figure 2:
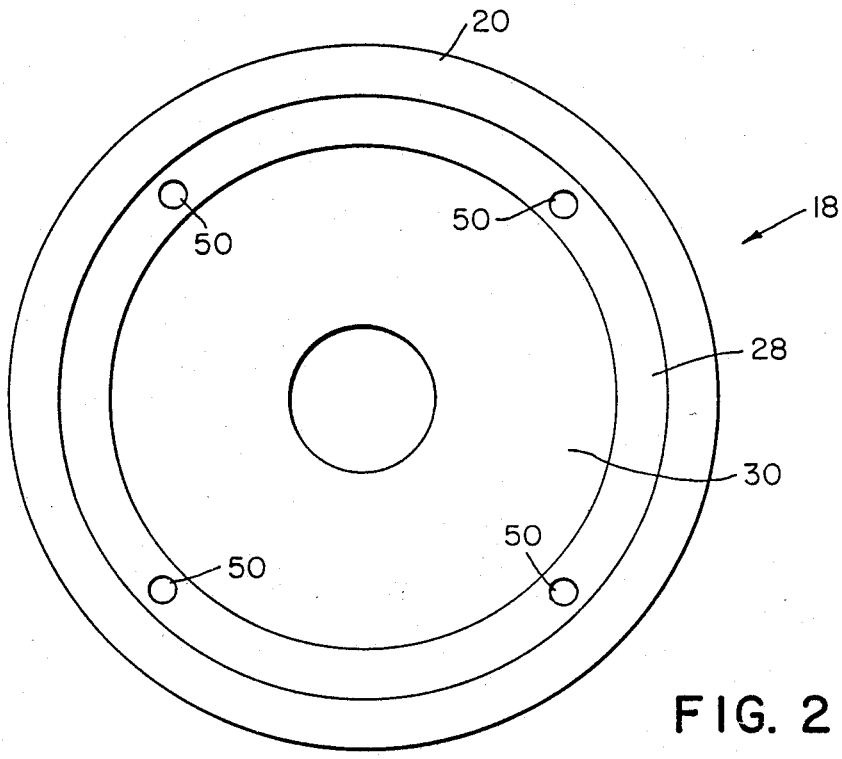
FIG. 2 is a top plan view of the bowl-shaped connector body of the floor drain shown in FIG. 1.

Although as illustrated in FIGS. 2, 3, and 4, the strainer plate has four positioning pins that are not equidistantly circumferentially positioned, and the connector body has four corresponding positioning holes, those skilled in the art will recognize that more or fewer positioning pins and positioning apertures can be provided, if desired, and they can also be equally circumferentially positioned relative to the axis of the drain assembly.

Although particular embodiments of the present invention have been illustrated and described, it will be apparent to those skilled in the art that various changes and modifications can be made without departing from the spirit of the present invention. It is therefore intended to encompass within the apended claims all such changes and modifications that fall within the scope of the present invention.

What is claimed is:

1. A plastic floor drain comprising;

(a) a rigid plastic, bowl-shaped connector body having a longitudinal axis and including an upper surface having an inlet opening, and a lower surface having an outlet opening, the inlet opening having a larger area than the area of the outlet opening, the connector body including an outwardly extending annular flange adjacent to and extending around the inlet opening to define a flat upper flange surface and a recessed annular seat below the upper flange surface, and a plurality of circumferentially spaced positioning apertures in the annular seat, the positioning apertures located between inner and outer edges of the recessed annular seat and having their axes extending in the direction of the connector body longitudinal axis, the positioning apertures also having walls that taper downwardly from the annular seat and inwardly relative to their axes, and (b) a rigid plastic strainer plate positioned adjacent the inlet opening of the connector body and having a plurality of drain apertures extending therethrough, the strainer plate being in the form of a solid disc having a thickness substantially equal to the distance between the upper flange surface and the recessed annular seat of the connector body and having an upper surface, a lower surface that is received on the annular seat, and a peripheral edge, a plurality of positioning pins carried by the strainer plate and depending from the strainer plate lower surface, each of the positioning pins spaced inwardly of the strainer plate peripheral edge and received in respective ones of the positioning apertures of the connector body in friction-fit relationship therewith, the strainer plate upper surface being substantially co-planar with the upper surface of the annular flange to provide a smooth upper surface for the floor drain when the strainer plate and connector body are assembled.

2. A plastic floor drain in accordance with claim 1, wherein the positioning pins are cylindrical.

3. A plastic floor drain in accordance with claim 1, wherein the positioning apertures include a first, upper cylindrical portion, and a second, lower, downwardly and inwardly tapered portion.

4. A plastic floor drain in accordance with claim 1, wherein the positioning pins taper inwardly and downwardly and have a smaller cross-sectional area at outermost portions thereof, relative to innermost portions adjacent the strainer plate lower surface.

5. A plastic floor drain in accordance with claim 1, wherein the connector body includes a bowl wall having a bowl outer wall surface and a bowl inner wall surface, and the positioning apertures extend partially into the bowl wall and partially into positioning sleeves that include sidewalls that extend radially outwardly at the bowl outer wall surface.

6. A plastic floor drain in accordance with claim 5, wherein the positioning apertures are closed at the bottom of the positioning sleeve.

7. A plastic floor drain as claimed in claim 6, wherein the positioning sleeves each include an inner wall that defines a transversely extending inner stop surface at the bottom of the positioning apertures.

8. A plastic floor drain in accordance with claim 7 wherein the stop surface extends perpendicular to the connector body axis.

9. A plastic floor drain in accordance with claim 1, wherein the connector body includes four positioning apertures, and the strainer plate includes four positioning pins, the positioning pins and positioning apertures define diametric pairs, and the circumferential spacing between the respective pairs is unequal.

10. A plastic floor drain in accordance with claim 1, wherein the strainer plate, the connector body inlet, the connector body bowl, the connector body outlet, are each circular in cross section.

11. A plastic floor drain in accordance with claim 1, wherein the connector body and strainer plate are each formed from polyvinyl chloride plastic.

12. A plastic floor drain in accordance with claim 1, wherein the strainer plate and connector body are each formed from acrylonitrile butadiene styrene plastic.

13. A plastic floor drain in accordance with claim 1, wherein the strainer plate includes a pair of opposed, inwardly extending notches formed in the peripheral edge thereof to permit the strainer plate to be removed by inserting a prying tool into the notches to pry the plate upwardly to overcome the friction fit between the positioning pins and the positioning apertures.

14. A plastic floor drain in accordance with claim 13, wherein the notches include innermost walls that taper inwardly from the upper surface of the strainer plate to the lower surface thereof.

* * * * *